US007055226B2

(12) United States Patent
Uehara et al.

(10) Patent No.: US 7,055,226 B2
(45) Date of Patent: Jun. 6, 2006

(54) BUCKLE

(75) Inventors: Ryoichiro Uehara, Toyama-ken (JP); Tomohisa Ishida, Saitama-ken (JP); Yukio Kamagata, Tokyo-to (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/963,577

(22) Filed: Sep. 27, 2001

(65) Prior Publication Data

US 2002/0040514 A1 Apr. 11, 2002

(30) Foreign Application Priority Data

Sep. 27, 2000 (JP) ..... 2000-293451

(51) Int. Cl.
*A44B 11/25* (2006.01)

(52) U.S. Cl. ..... 24/625

(58) Field of Classification Search ..... 24/614–616, 24/625; 403/326, 329
See application file for complete search history.

(56) References Cited

U.S. PATENT DOCUMENTS 3,600,917 A * 8/1971 Krock
3,979,934 A * 9/1976 Isenmann
4,679,282 A * 7/1987 Feng
4,802,262 A * 2/1989 Kasai
5,561,891 A * 10/1996 Hsieh
5,590,444 A 1/1997 Krauss
6,052,875 A 4/2000 Fudaki
6,247,213 B1 6/2001 Uehara
6,351,876 B1 * 3/2002 Uehara
D468,233 S * 1/2003 Della Valle ..... D11/216

FOREIGN PATENT DOCUMENTS

EP 0 648 441 A1 4/1995
FR 2 783 679 9/1999
JP 8-131215 * 5/1996
JP 9-135709 5/1997

* cited by examiner

*Primary Examiner*—James R. Brittain
(74) *Attorney, Agent, or Firm*—Finnegan, Henderson, Farabow, Garrett & Dunner, L.L.P.

(57) ABSTRACT

A buckle, which comprises a female body and a male body, which may be inserted each other and prevents rocking in right and left directions and clattering of the female body and the male body at the time, is provided. A buckle comprising a female body formed with a flat housing and a male body having a pair of right and left flexible insertion legs, wherein when the female body and the male body are inserted to engage, the butting surfaces between the female body and the male body on a plane, that is, butting portions are formed with horizontal straight portions on both sides of the butting portions as well as a concave portion at the center in female body and a convex portion in the male body, or a convex portion in the female body and a concave portion in the male body continuously formed, so as to join the female body to the male body in the condition closely in contact.

7 Claims, 18 Drawing Sheets

<PRIOR ART>

<PRIOR ART>

BUCKLE

BACKGROUND OF THE INVENTION

1. Field of the Invention

The present invention relates to a buckle for tightening a belt comprising a female member formed with a flat housing and a male member having a pair of flexible insertion legs, in which a pair of the flexible insertion legs of the male member are inserted into the housing of the female member and engaged therein.

2. Description of the Related Art

A conventional insertion type buckle comprising a female member, that is, female body, formed with a flat housing and a male member, that is, male body, having a pair of flexible insertion legs is well-known to have a butting portion of the female body and the male body, which is formed in a simple straight form when the female body and the male body are engaged. As shown in FIG. 28, a buckle of a type to finish an insertion opening 7' of the flat housing 3' of the female body 1' into a straight form, bring a front end of a side frame on each of both sides in the frame 20' of the belt through portion into contact with the insertion opening 7' edge of the housing 3' in the male body 2', and butt both members each other, is well-known. This kind of buckle is disclosed, for example, in Japanese Patent Application Laid-Open No. 9-135609.

Furthermore, as shown in FIG. 29, a buckle comprising a female body 1" formed with a flat housing 3" and a male body 2" having a pair of insertion legs 30", in which the butting portions 15", 38" of the female body 1" and the male body 2", when the insertion legs 30" of the male body 2" is inserted into the housing 3" of the female body 1" in an insertion form, are slightly cut off in a curved form at both ends of the female body 1" and formed to slightly protrude in an arcuate form at both ends of the male body 2". Then, the relevant ends are connected at a central straight portion is disclosed in U.S. Pat. No. 5,590,444.

In the conventional buckle described above in which the insertion opening of the housing of the female body and the base of the insertion legs of the male body are formed in a straight line and a butting surface between the female body and the male body is also formed in a straight line. In the buckle shown in FIG. 28, the insertion opening 7' of the housing 3' of the female body 1' is formed in a straight line, and in the male body 2', the front ends of both side frames in the frame 20' of the belt through portion are brought into contact with the insertion opening 7'. As for the buckles described above, the buckles may clatter and lack stability when the female body 1' and the male body 2' are engaged by insertion, and further, no smooth inserting operation is expected only with the guide member 35' at the center when the insertion legs 30' are inserted into the housing.

In the buckle shown in FIG. 29, because the butting surface between the female body 1" and the male body 2" is held by the bent portions at the ends on both sides of the buckle when the insertion legs 30" of the male body 2" is inserted into the housing 3" of the female body 1", there is such a problem that any clearance on the right and left causes the female body 1" and the male body 2" to slip and results in clattering.

SUMMARY OF THE INVENTION

The invention has been made with the above-mentioned problems taken into account, and an object of the invention is to provide a buckle comprising a female body formed with a flat housing and a male body having a pair of flexible insertion legs, wherein when the female body and the male body are inserted to engage, a shape of a plane of a butting surface between the female body and the male body, that is, a butting portion, forms horizontal straight portions on both sides of the butting portion as well as a concave portion at center in one of the bodies and a convex portion in the other body, and the buckle securely prevents rocking of right and left directions at the center of the butting portion, restricts and holds the female body and the male body in a stable condition, prevents clattering of the buckle, and achieves the inserting action under the smooth and stable guide.

Another object of the invention is to provide a buckle, wherein the butting face comprising the straight portions and the concave or convex portion is formed on both front and rear surfaces of the buckle. With the structure, the butting surface suitable for a buckle having a plane configuration of a side surface is formed and the butting portion can accept the insertion from any surface.

Also another object of the invention is to provide a buckle of a type that prevents the buckle from being inserted reversely with respect to the front and rear surfaces of the buckle by forming the butting surface comprising the straight portion and the concave or convex portions on one face of the buckle only to form the butting portion suited for the buckle having a curved configuration on the side surface thereof.

And another object of the invention is to provide a buckle having an ideal butting portion that achieves good guiding capability in inserting action of the female body and the male body and can prevent clattering of the buckle as well as the buckle having the butting portion with good stability and excellent design.

Still another object of the invention is to provide a buckle that allows the female body and the male body to successfully join by forming the center in the butting surface between the female body and the male body into a concave form for the female body and a convex form for the male body to finish the buckle with stable design, and forming the butting surface of the male body into a special shape.

Finally, also another object of the invention is to provide a buckle finished into a buckle of special designs by forming the center portion in the butting surface between the female body and the male body into a convex form for the female body and a concave form for the male body, and having the functions that can prevent loosening of the belt attached to the male body.

In order to achieve the above-mentioned objects, the main aspect of the invention provides a buckle comprising a female body formed with a flat housing and a male body having with a pair of right and left flexible insertion legs which are engaged with each other by insertion, wherein a concave portion or a convex portion is provided at the center of the butting surface on the plane of the female body and the male body, that is, the butting portions when the female body engages with the male body, and the female body and the male body are thereby formed closely in contact.

Preferably, horizontal straight portions are provided on both sides of the butting surface.

Preferably, the butting portions comprising straight portions on both sides of the buckle and the concave portion or the convex portion at the center are formed on both front and rear surfaces of the female body and the male body.

Alternately, the butting portions comprising the straight portions on both sides of the buckle and the concave portion or the convex portion at the center are formed respectively on one surface of the female body and the male body.

Preferably, the convex portion is formed in such a manner to be protruded in a trapezoidal form where a front end is slightly narrowed, the concave portion is formed in such a manner to be concavely dented with the inlet expanded, and the straight portions and the convex portion or concave portion are combined so as to form the butting portions to be formed in the female body and the male body.

Alternately, the convex portion is formed in such a manner to protrude arcuately, the concave portion is formed in such a manner to curve in arcuately, and the straight portions and convex portion or concave portion are combined so as to form the butting portions to be formed in the female body and the male body.

Preferably, the butting portion to be formed in the female body is formed with the straight portions and the concave portion and the butting portion to be formed in the male body is formed with the straight portions and the convex portion, such that both butting portions are combined.

Alternately, the butting portion to be formed in the female body is formed with the straight portions and the convex portion and the butting portion to be formed in the male body is formed with the straight portions and the concave portion, such that both butting portions are combined.

Preferably, peripheral ends, that is, corners of the straight portions on both sides and the convex portion at the center of the male body are notched to form a one level lower stepped portion, which is formed to be fitted into the butting portion of the female body 1 in the manner of overlapping.

Further preferably, the concave portion provided at the center of the male body is formed concavely up to a belt through hole provided in the male body, while the convex portion of the female body that corresponds to the concave portion is extended to the belt through hole upon the insertion of the bodies.

Alternately, the concave portion provided at the center of the male body is formed concavely up to the belt through hole provided in the male body, while the convex portion of the upper plate of the female body that corresponds to the concave portion is extended to a top surface of the belt through hole of the male body or a top surface of a belt hooking rod upon the insertion of the bodies so that the belt is prevented from its loosening.

DESCRIPTION OF THE PREFERRED EMBODIMENTS

Figure 1:
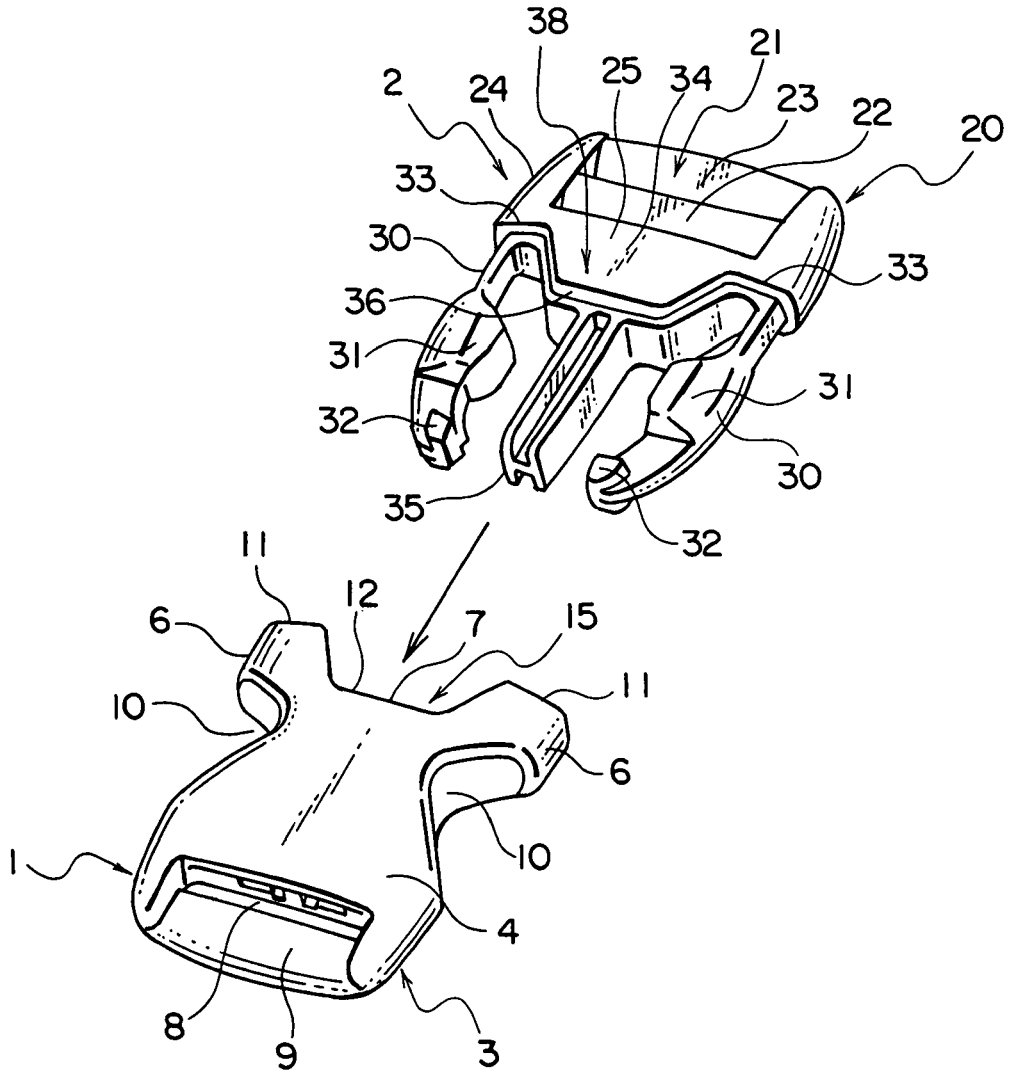
FIG. 1 is a perspective view of a buckle according to a first embodiment of the invention.
Figure 2:
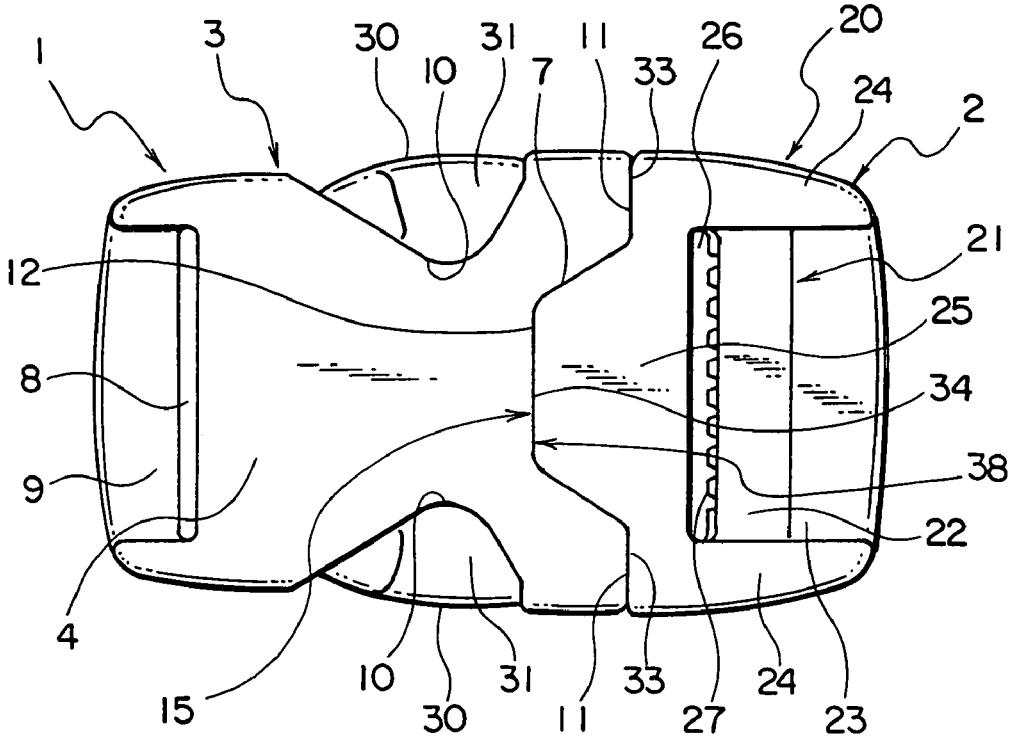
FIG. 2 is a front view showing an engagement state of the buckle of FIG. 1.
Figure 3:
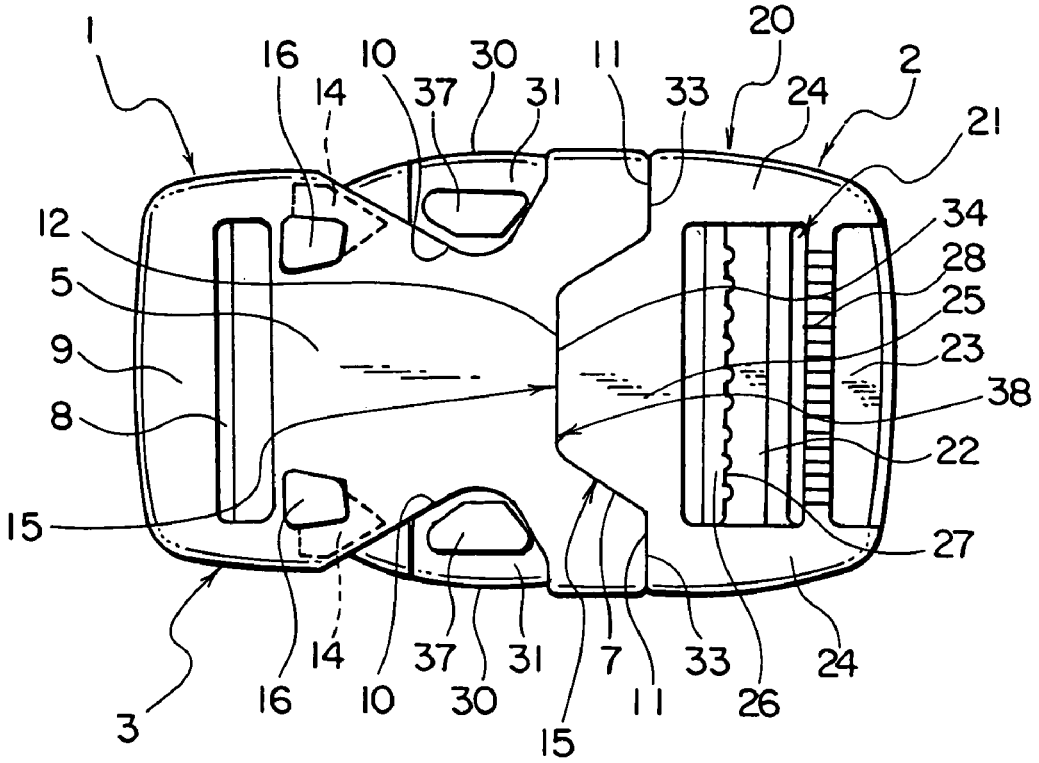
FIG. 3 is a back view showing the engagement state of the buckle of FIG. 1.
Figure 4:
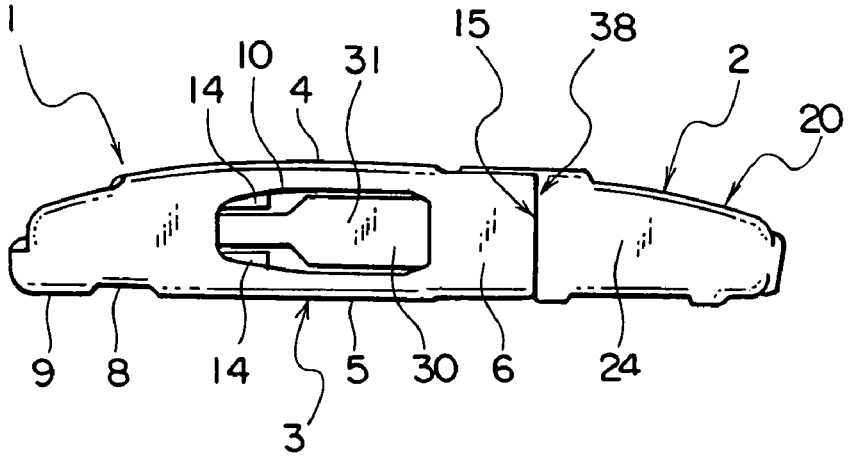
FIG. 4 is a side view showing the engagement state of the buckle of FIG. 1.
Figure 5:
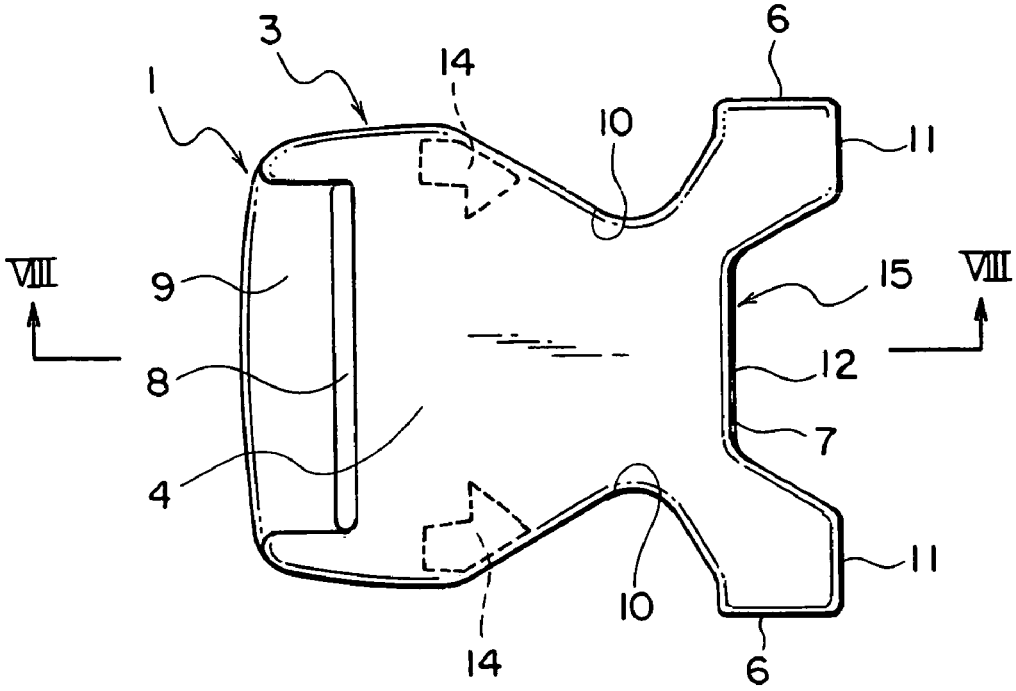
FIG. 5 is a front view of a female body of the buckle of FIG. 1.
Figure 6:
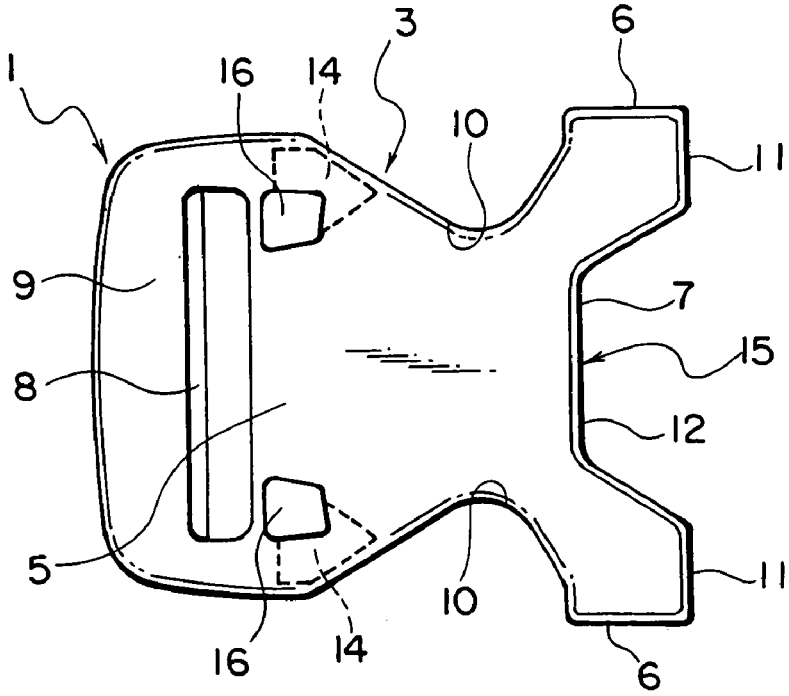
FIG. 6 is a back view of the female body of the buckle of FIG. 1.
Figure 7:
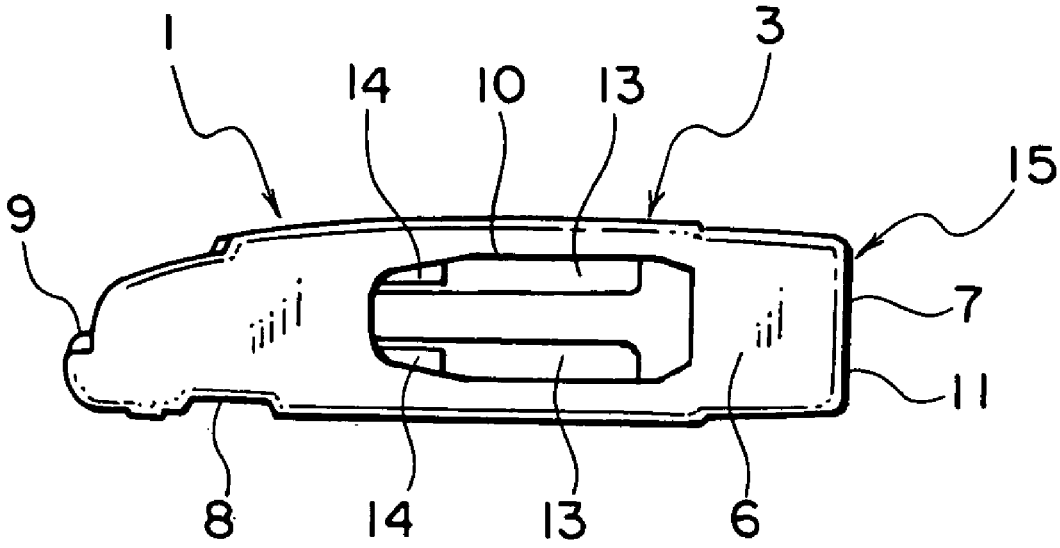
FIG. 7 is a side view of the female body of the buckle of FIG. 1.
Figure 8:
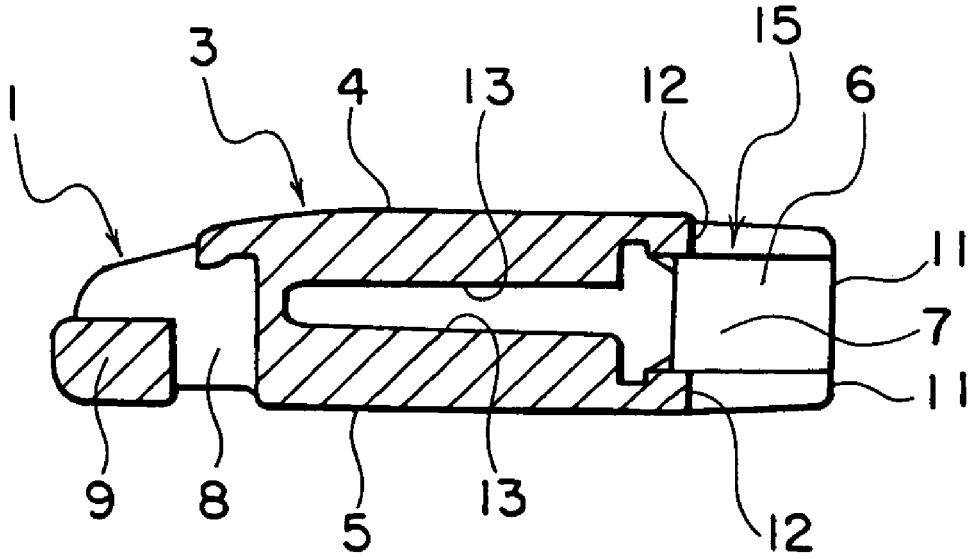
FIG. 8 is a cross-sectional view of the buckle of FIG. 1 taken along the line VIII—VIII of FIG. 5.
Figure 9:
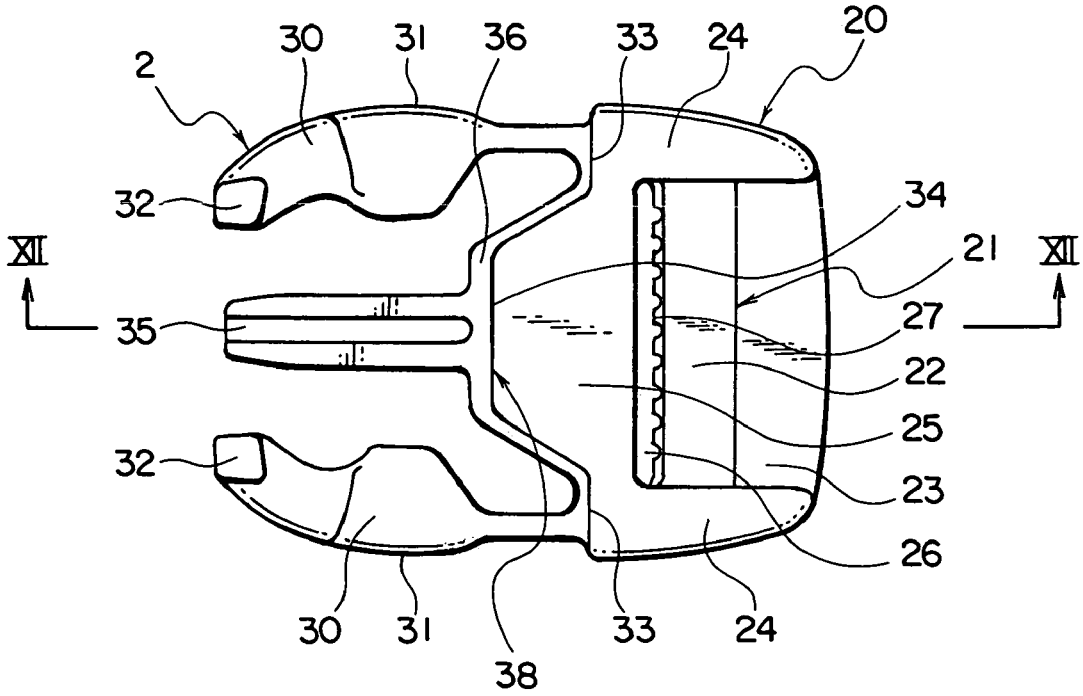
FIG. 9 is a front view of a male body of the buckle of FIG. 1.

Hereinafter, with referring to the drawings, embodiments of a buckle according to the invention will be concretely explained.

A buckle according to the invention comprises a female body 1 formed with a flat cylindrical housing 3 and provided with cut-outs 10 provided on both sides of the housing 3, and a male body 2 having a pair of flexible insertion legs 30 protruded from a frame 20 to which a belt adjusting portion 21 is equipped as shown in FIG. 1, wherein the insertion legs 30 of the male body 2 is inserted into the housing 3 of the female body 1 to engage, and the female body 1 and the male body 2 of the buckle are integrally molded by injection molding means with thermoplastic resins such as polyacetal, polyamide, polypropylene, polybutyleneterephthalate, etc.

To explain the buckle of a first embodiment of the invention shown in FIGS. 1 through 12, the female body 1 is formed from a flat cylindrical housing 3 comprising an upper plate 4, a lower plate 5, and side walls 6 as shown in FIGS. 5 through 8, an insertion opening 7 to which flexible insertion legs 30 of the male body 2 can be inserted is provided at one end of this housing 3, and a belt through hole 8 and a belt attaching rod 9 are disposed to attach a belt at the other end, and in each of both side walls 6 of the housing 3, a cut-out 10 notched concavely is formed so that the flexibly insertion legs 30 of the male body 2 can be pressed on its operation.

A horizontal straight portions 11 are disposed on both sides of the insertion opening 7 of the housing 3 and at the center of the insertion opening 7, a concave portion 12 dented concavely and having a slightly expanded inlet is provided continuously so as to form the butting surface with the male body 2, that is, the butting portion 15. In the inside of the housing 3, a partition piece 13 is disposed so as to protrude on the upper plate 4 and to the lower plate 5 in the central longitudinal direction to guide a guide member 35 of the male body 2. In addition, on the inner surfaces of both of the upper plate 4 and the lower plate 5 on the side of the belt through hole 8, engaging protrusions 14 that can be engaged respectively with an engaging portion 32 of the insertion leg 30 of the male body 2 are protruded. The numeral 16 denotes a core aperture for molding the engaging protrusion 14.

The male body 2 has a U-letter shaped frame 20 with a belt adjusting portion 21 provided on one end thereof as shown in FIGS. 9 through 12, and the adjusting portion 21 has a hooking rod 22 for catching the belt and a fastening rod 22 for fixing the belt such that they bridge the side frame 24 of the frame 20 in parallel, and a belt through hole 26 is formed between a base 25 of the frame 20 and the hooking rod 22. The hooking rod 22 has locking pawls 27 protruded horizontally towards the base 25, and a wave-like fastening portion 28 is provided at the rear surface of the front end of the hooking rod 23 to prevent the belt from sliding.

The flexible insertion legs 30 capable of being inserted into the housing 3 of the female body 1 and engaged therewith are provided on both sides of the base 25 of the frame 20 so as to protrude, and the flexible insertion legs 30 have an enlarged pressing portions 31, that can be fitted into the cut-out 10 of the housing 3, at the middle of the insertion legs 30, and the front end side of the insertion leg 30 is formed slightly bent inwardly to enable easy insertion and removal to and from the housing 3 and the engaging portions 32 that can engage with the engaging protrusions 14 of the female body 1 are formed on the front and rear surfaces of the front end of the insertion legs 30. When the insertion leg 30 is inserted in the housing 3, by pressing the pressing portion 31 of the insertion leg 30 appearing from the side of the housing 3, the engaging portion 32 can be separated from the engaging protrusion 14 and then, the male body 2 removed from the female body 1 in compliance with the warp of the insertion leg 30.

The front end of the base 25 on both sides of the frame 20, that is, the portion where the insertion leg 30 is provided so as to protrude is formed into a horizontal straight portion 33, and at the center of the frame 20, a convex portion 34 that protrudes out forward is disposed, and this convex portion 34 is formed in a trapezoidal form with the front end slightly narrowed, and the butting surface with the female body 1, that is, the butting portion 38, is thereby formed. At the front end of this trapezoidal convex portion 34, a guide member 35 with H-letter shaped cross section is protruded, and the guide member 35 is allowed to be inserted along the partition piece 13 protruded on the inner surface of the housing 3.

Figure 10:
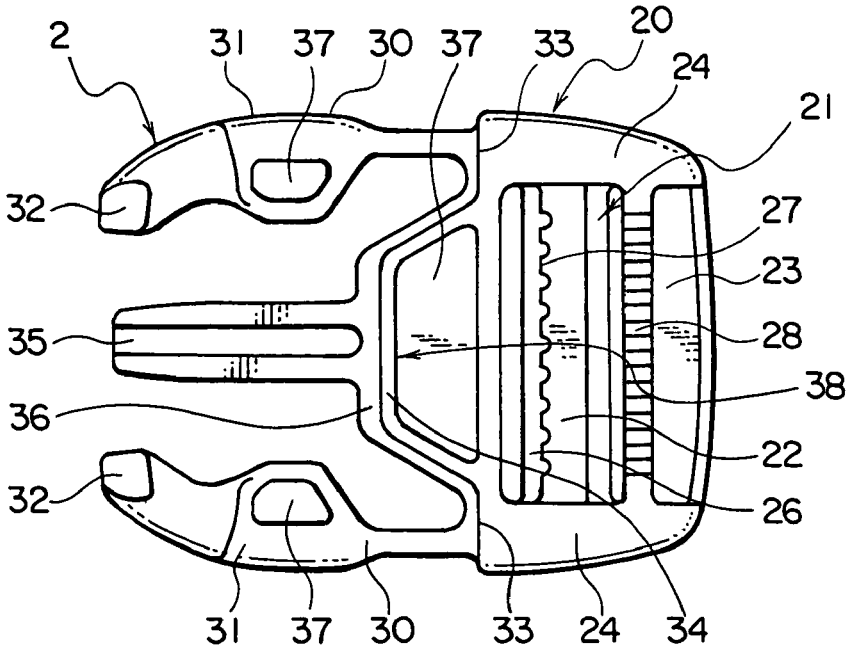
FIG. 10 is a back view of the male body of the buckle of FIG. 1.
Figure 11:
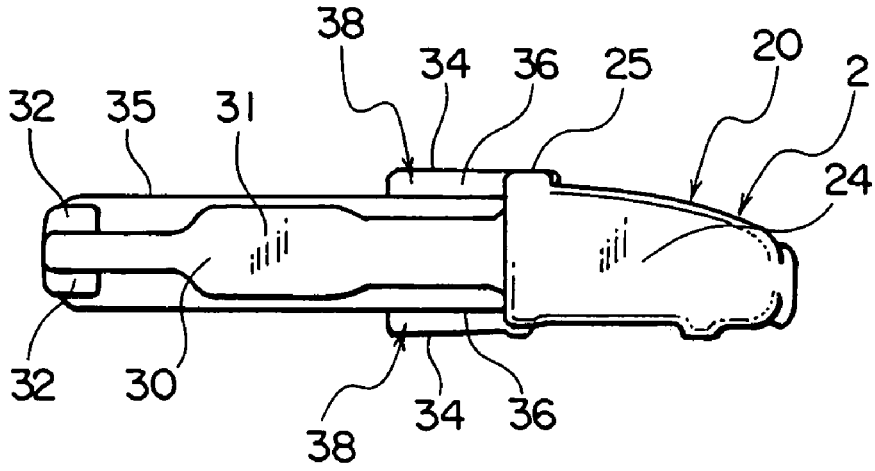
FIG. 11 is a side view of the male body of the buckle of FIG. 1.
Figure 12:
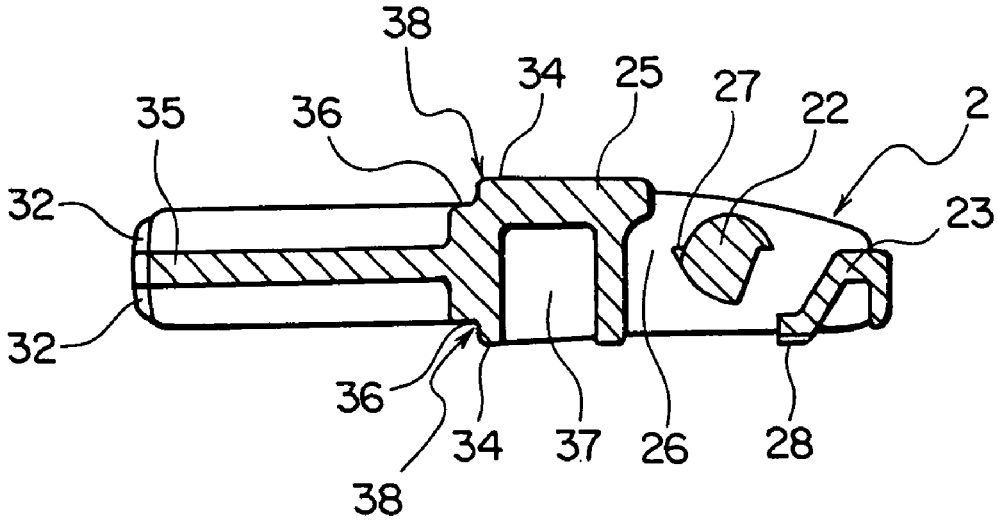
FIG. 12 is a cross-sectional view of the buckle of FIG. 1 taken along the line XII—XII of FIG. 9.

The straight portions 33 on both sides in both front and rear surfaces of the frame 20 and the peripheral edge of the convex portion 34 at the center have the notched corners to form a stepped portion 36 that becomes one step lower around the peripheral edge as shown in FIG. 12. This stepped portion 36 is fitted into the insertion opening 7 of the housing 3 in an overlapping manner to secure stable insertion when the insertion legs 30 of the male body 2 are inserted into the housing 3 of the female body 1. As shown in FIG. 10, on the rear surface of the convex portion 34 and the pressing portions 31 of the insertion legs 30, recesses 37 are formed for reduce the weight of the buckle.

This buckle has a pair of the flexible insertion legs 30 and guide member 35 of the male body 2 inserted from the insertion opening 7 of the housing 3 of the female body 1, wherein the external surface of the flexible leg 30 is guided by the side wall 6 of the housing 3 and the guide member 35 is inserted by being guided by the partition pieces 13 formed on the inner surfaces of the upper plate 4 and the lower plate 5 of the housing 3, the engaging portions 32 disposed on the front and rear surface of the front ends of the flexible insertion legs 30 are engaged with the engaging protrusions 14 protruded on the inner surfaces of the upper plate 4 and the lower plate 5 of the housing 3, so that the butting portions 15, 38 formed on the female body 1 and the male body 2 are butted and fixed in a closely contacted condition. To attach the belt to the buckle, one end of the belt is attached to the belt attaching rod 9 of the female body 1 and the other end is wrapped around the hooking rod 22 from the bottom surface of the belt fastening rod 23 of the belt adjustment portion 21 of the male body 2, and is allowed to pass the bottom surface of the fastening member 23 pulled out outward to equip the belt.

The features of the buckle according to the invention lie in the butting surface, that is, the butting portion 15, formed at the insertion opening 7 of the housing 3 of the female body 1 and the butting surface, that is, the butting portion 38 formed at the front surface of the frame 20 of the male body 2, wherein straight portions 11, 33 are disposed on both sides of the butting portions, respectively, a concave portion 12 is formed continuously in contact with the straight portions 11, 33 at the center of the female body 1 and a convex portion 34 is formed at the center of the male body 2, and when the male body 2 is inserted into the female body 1, the convex portion 34 at the center is restricted as if the concave portion 12 holds the convex portion 34 at the center by the straight portions 11, 33 on both sides, and the concave portion 12 and the convex portion 34 at the center, thereby positively preventing rocking, that is, clattering of the buckle in the right and left directions in a simple constitution.

Figure 13:
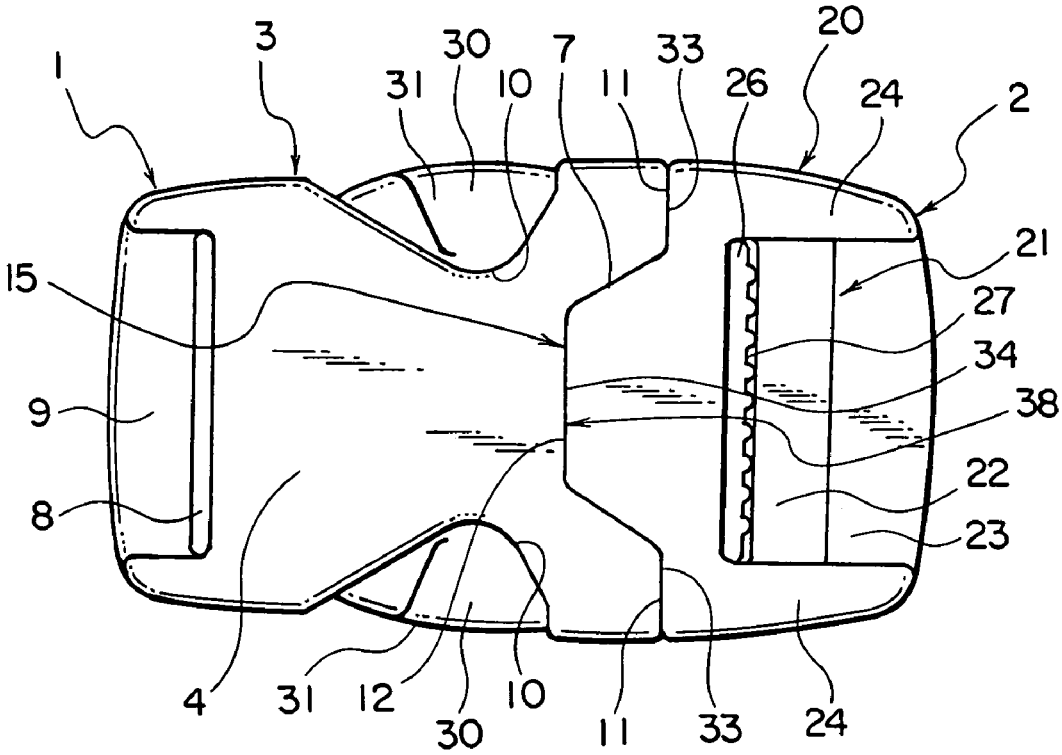
FIG. 13 is a front view showing an engagement state of a buckle according to a second embodiment of the invention.
Figure 14:
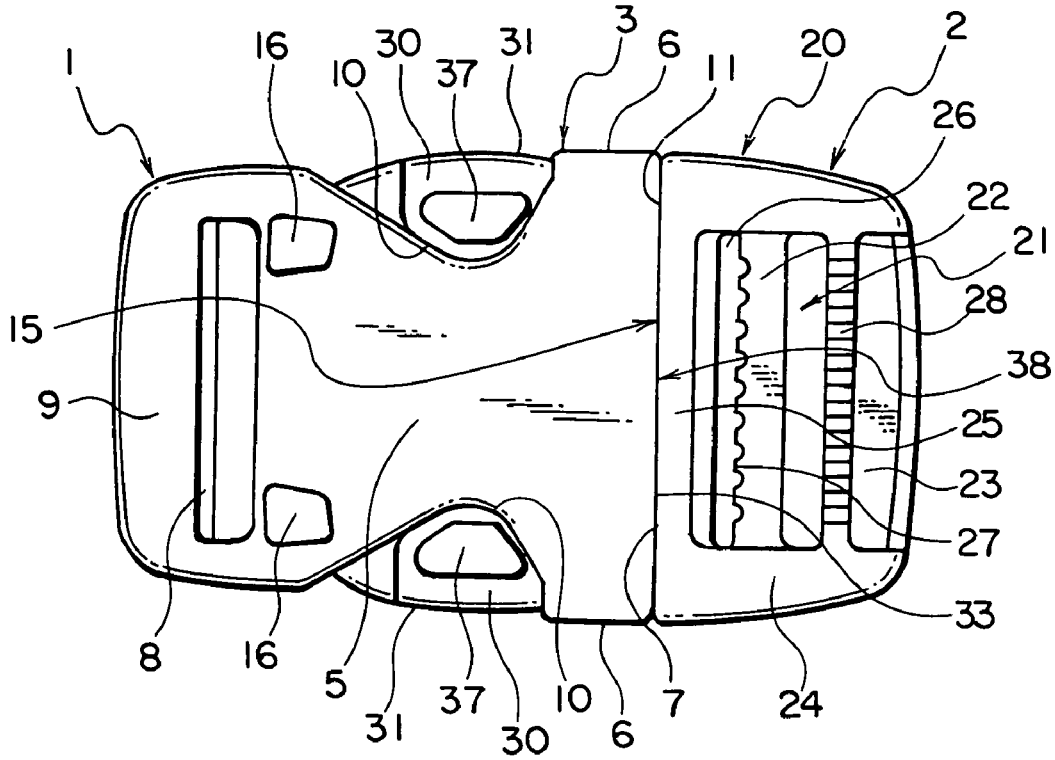
FIG. 14 is a back view showing the engagement state of the buckle of FIG. 13.
Figure 15:
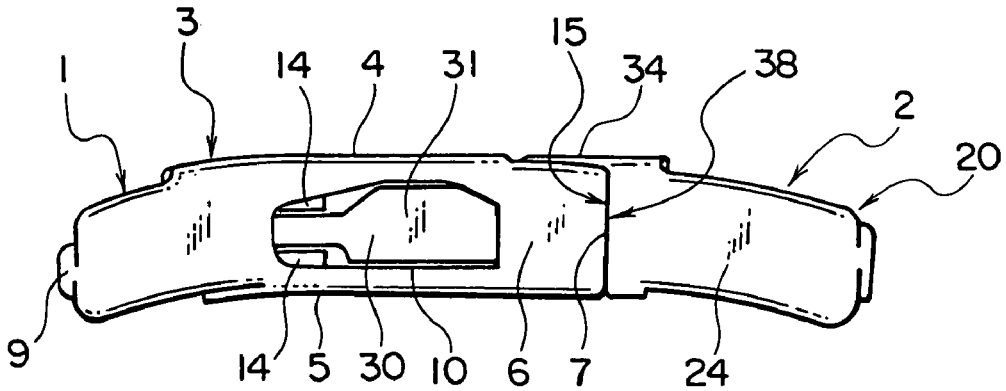
FIG. 15 is a side view showing the engagement state of the buckle of FIG. 13.
Figure 16:
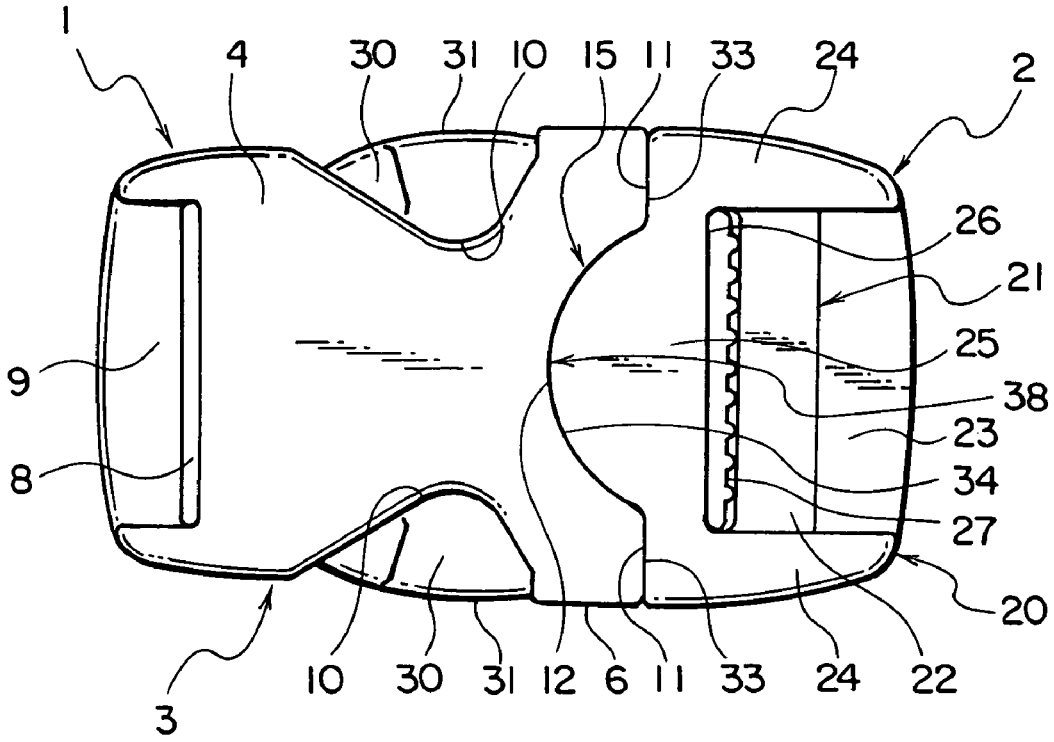
FIG. 16 is a front view showing an engagement state of a buckle according to a third embodiment of the invention.
Figure 17:
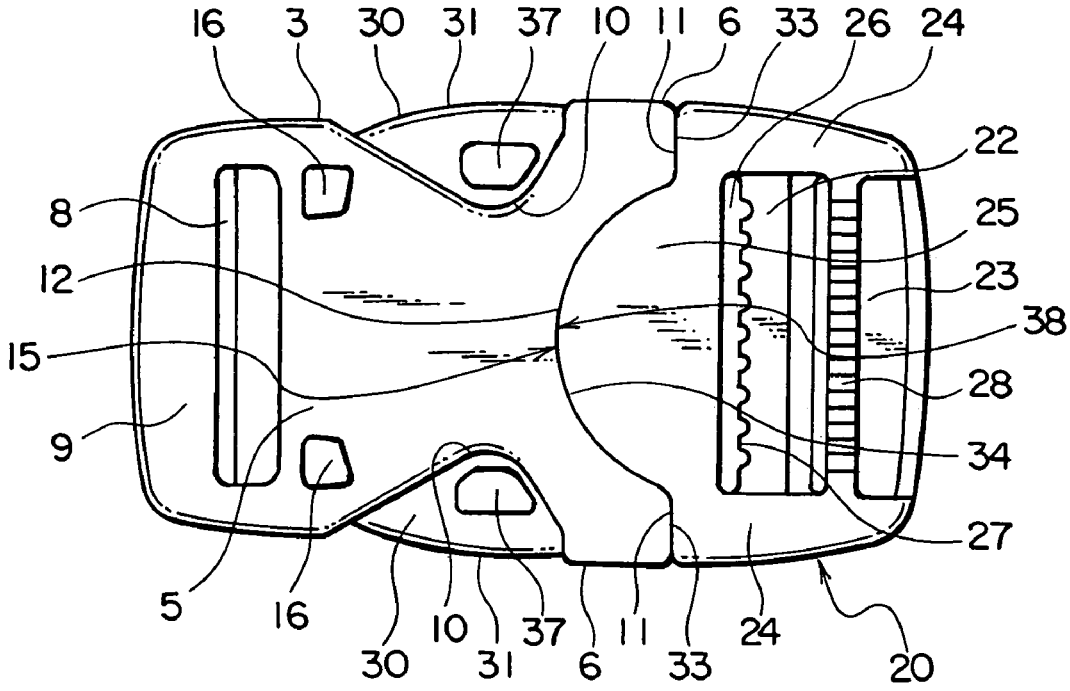
FIG. 17 is a back view showing the engagement state of the buckle of FIG. 16.
Figure 18:
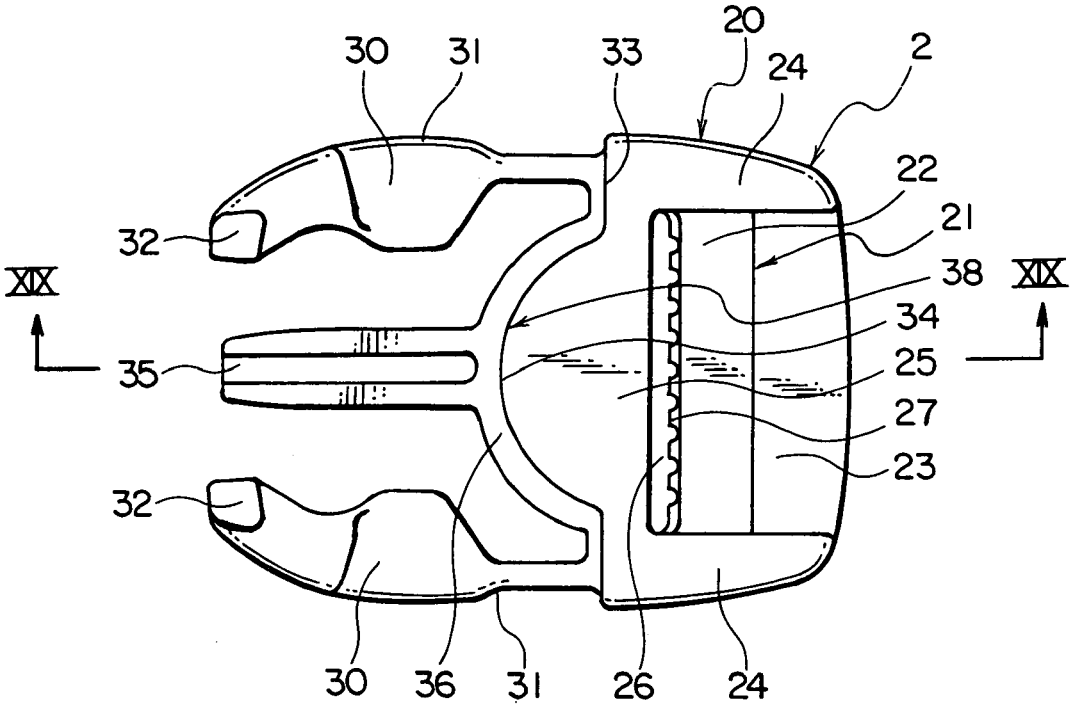
FIG. 18 is a front view of a male body of the buckle of FIG. 16.
Figure 19:
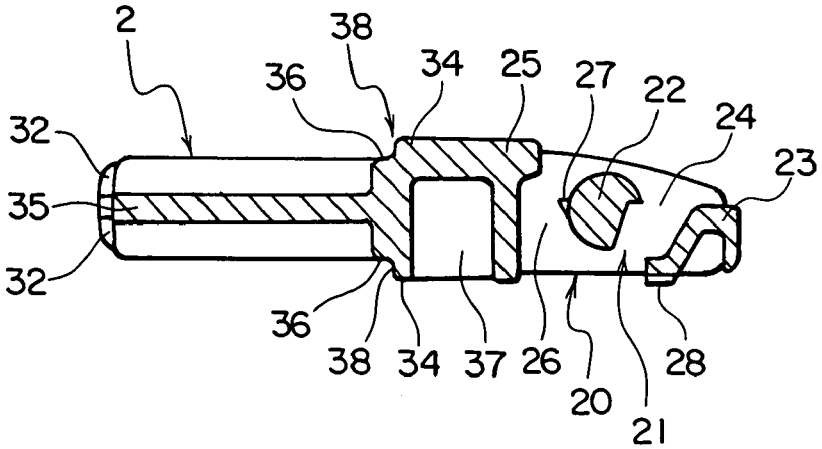
FIG. 19 is a cross-sectional view of the buckle of FIG. 16 taken along the line XIX—XIX of FIG. 18.
Figure 20:
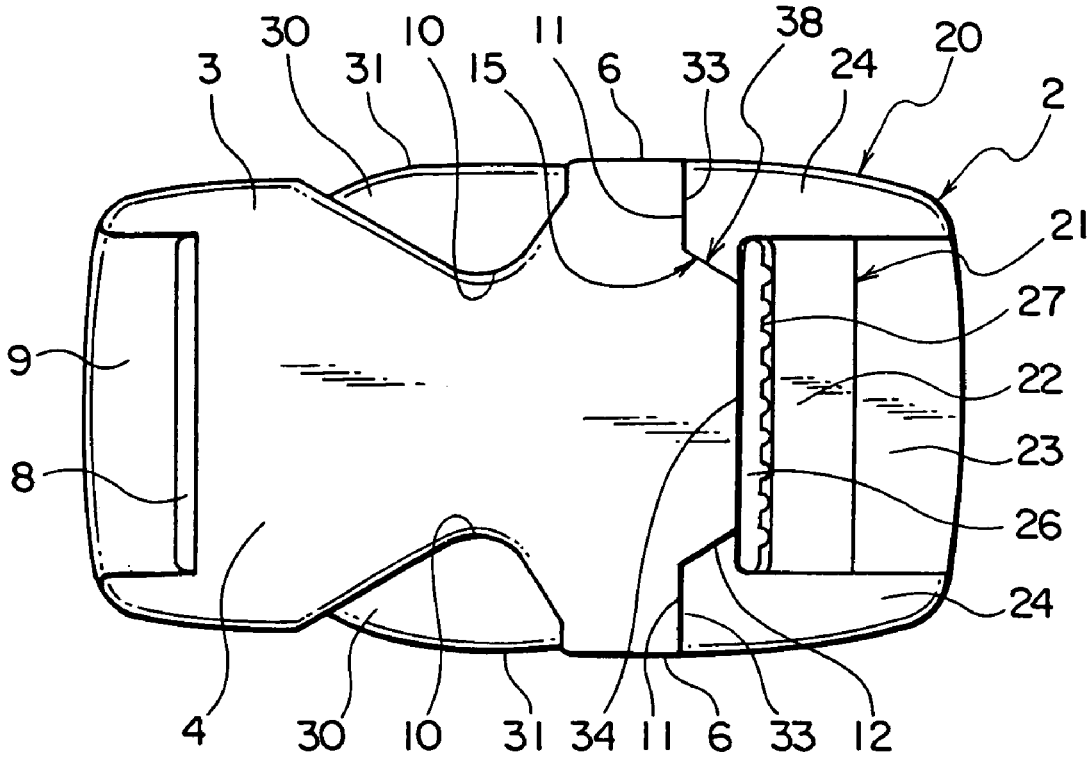
FIG. 20 is a front view showing an engagement state of a buckle according to a fourth embodiment of the invention.
Figure 21:
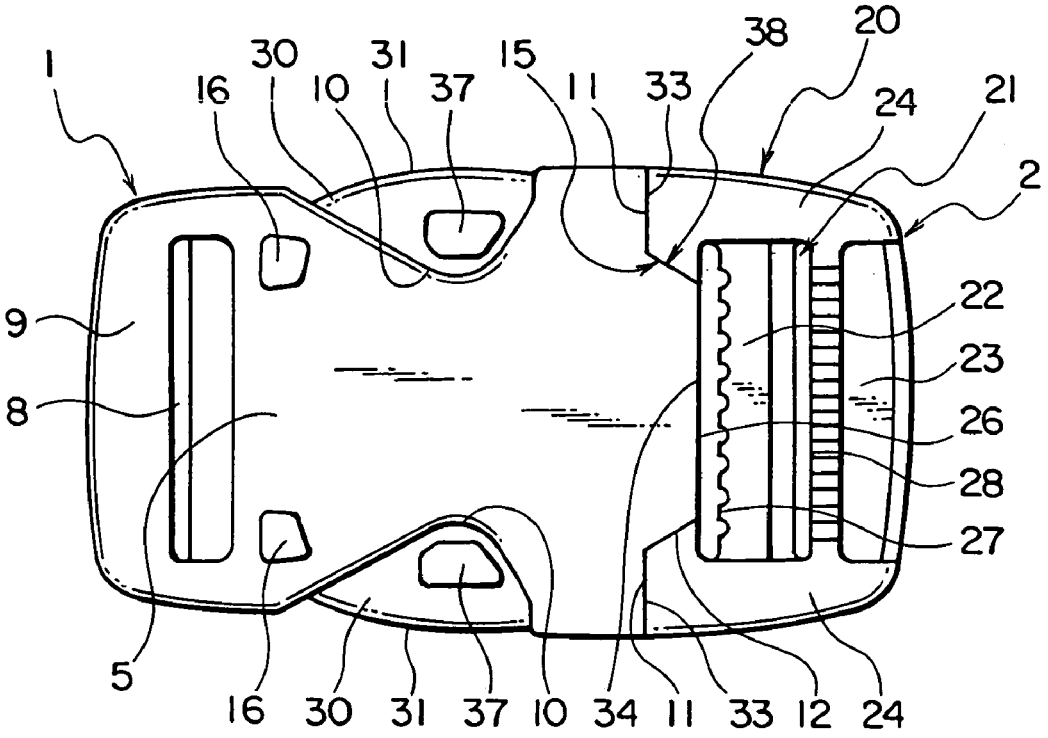
FIG. 21 is a back view showing the engagement state of the buckle of FIG. 20.
Figure 22:
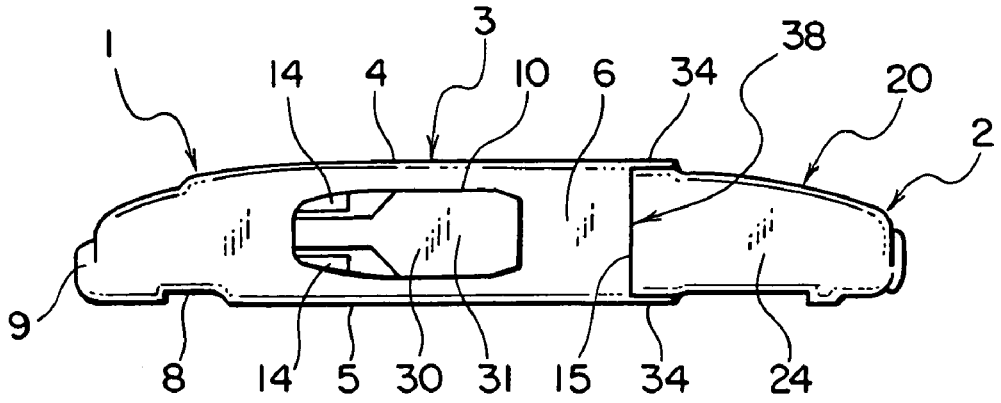
FIG. 22 is a side view showing the engagement state of the buckle of FIG. 20.

To describe a buckle of a second embodiment of the invention shown in FIGS. 13 through 15, the configurations of the top surfaces of the female body 1 and the male body 2 of this buckle are same as the configurations of the female body 1 and the male body 2 of the buckle of the first embodiment. That is, the female body 1 has the butting portion 15 formed on the upper plate 4 at the side of the insertion opening 7 of the housing 3, with horizontal straight portions 11 formed on both sides, a concavely dented concave portion 12 continuously disposed at the center with the entry slightly expanded, and cut-outs 10 concavely notched are disposed at the middle of the side walls 6 on both sides of the housing 3. The rear surface of the housing 3 differs in the constitution from the female body 1 of the first embodiment as shown in FIG. 14, in that the butting portion 15 of the lower plate 5 of the insertion opening 7 has the straight portions 11 on both sides and the whole butting portion is formed in the straight portion 11 by extending the straight portions 11 of both sides without forming the concave portion 12.

Consequently, for the male body 20, as well, the butting portion 38 formed at the base 25 on the top surface of the frame 20 has the horizontal straight portions 33 on both sides, a convex portion 34 that protrudes forward disposed at the center continuously in contact with this straight portion 33, and this convex portion 34 is formed in a trapezoidal form with the front end slightly narrowed. The butting portion 38 formed at the base 25 of the rear surface of the frame 20 is formed in such a manner that the whole exhibits a horizontal straight portion 33 as well as the case of the butting portion 15 of the female body 1. And on both sides of the base 25 of the frame 20, flexible insertion legs 30 are disposed and a guide member 35 at the center, and the belt adjusting portion 21 comprising the belt hooking rod 22 and the fastening rod 23 is disposed on the other side of the frame, and this constitution is the same as the male body 2 of the first embodiment.

The buckle of the type with the butting portions different on the front and the rear is applied to the buckle which is warped entirely as shown in FIG. 15, that is, the buckle of a curved form. In the buckle, the male body 2 is formed so as to be inserted in a specified direction only with respect to the female body 1, the use other than the normal condition is denied, and it is the feature of this buckle in that the male body 2 is unable to be inserted reversely with respect to the front and rear surfaces.

The corners of the peripheral edge of the butting portion 38 formed at the base 25 on the front and rear surfaces in the male body 2 of this buckle are notched to form a stepped portion 36, and when the male body is inserted into the housing 3 of the female body 1, the butting portions 15, 38 of both bodies are brought in close contact each other, the stepped portion 36 of the male body 2 is fitted into the insertion opening 7 of the housing 3 in the manner of overlapping, and the male body is able to be held in a stable condition.

To describe a buckle of a third embodiment of the invention shown in FIGS. 16 through 19, for the housing 3 of the female body 1 of the buckle, the butting portion 15 formed on the upper plate 4 and the lower plate 5 at the insertion opening 7 has horizontal straight portions 11 formed on both sides of the housing 3 and a concave portion 12 dented arcuately and curved in at the center continuously in contact with this straight portions 11. For the male body 2, the butting portion 38 formed at the base 25 of the frame 20 has the horizontal straight portions 33 formed on both sides and a convex portion 34 arcuately protruding forwards formed at the center continuously in contact with this straight portion 33, which can match the concave portion 12. The constitution of the female body 1 and male body 2 of this buckle other than the foregoing is the same as that of the first embodiment.

The butting portion 38 formed at the base 25 of the frame 20 on the front and rear surfaces in the male body 2 of this buckle has corners of peripheral edge of the straight portion 33 formed on both sides of the base 25 and convex portion 34 arcuately protruded at the center and the corners were notched to form a stepped portion 36. When the male body 2 is inserted in the housing 3 of the female body 1, the butting-portions 15, 38 of both bodies come in close contact, and the stepped portion 36 of the butting portion 38 of the male body 2 are fitted into the insertion opening 7 of the housing 3 in the manner of overlapping and hold the male body in a stable state.

To describe a buckle of a forth embodiment of the invention shown in FIG. 20 through FIG. 26, according to the buckle, the configurations of the butting portions 15, 38 of the female body 1 and the male body 2 differ from that of each of the above-mentioned embodiments, and is a buckle in which the convex portion 34 is formed on the female body 1 and the concave portion 12 is formed on the female body 2, thereby forming butting portions 15, 38.

Figure 23:
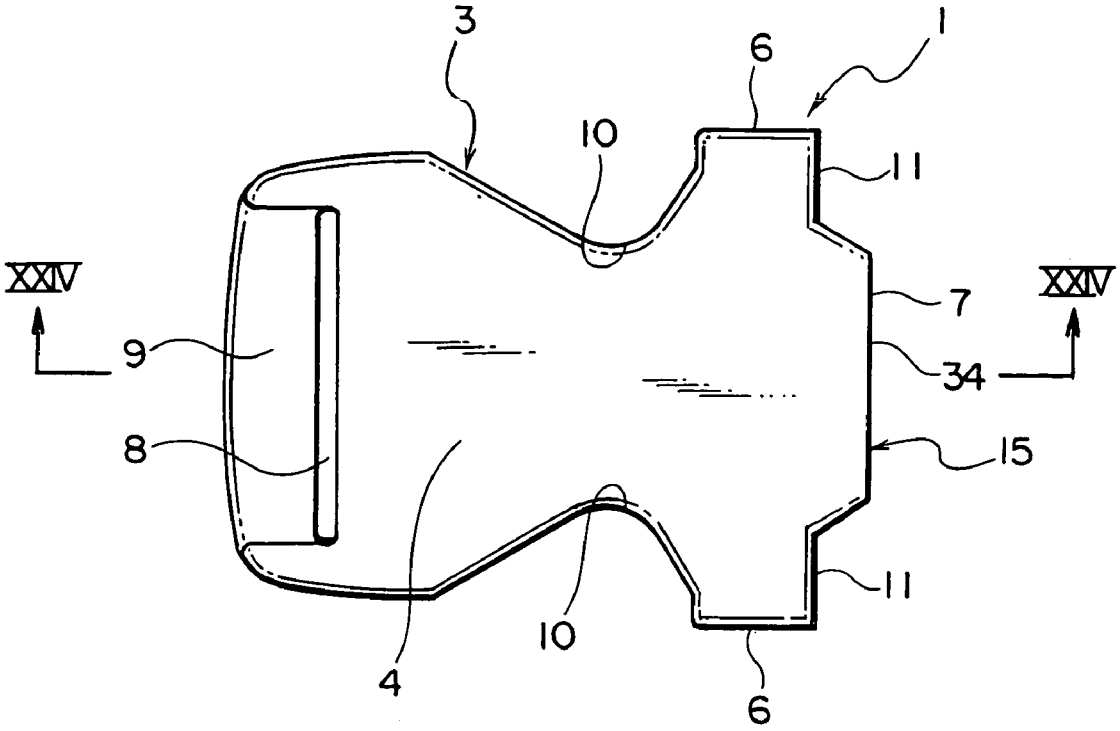
FIG. 23 is a front view of a female body of the buckle of FIG. 20.
Figure 24:
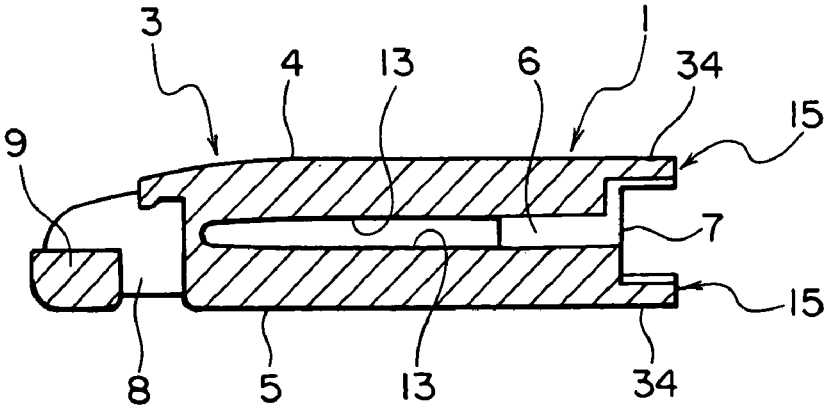
FIG. 24 is a cross-sectional view of the buckle of FIG. 20 taken along the line XXIV—XXIV of FIG. 23.

To describe this embodiment in detail, as shown in FIGS. 23 and 24, for the female body 1, the insertion opening 7 in the housing 3 has the horizontal straight portions 11 formed on both sides of the upper plate 4 and the lower plate 5 and a convex portion 34 trapezoidally protruding, with the front end slightly narrowed, formed at the center, thereby forming a butting portion 15. In the middle of each of the side walls 6 on both sides of the housing 3, a cut-out 10 concavely notched is disposed, and at the front end of the housing 3, a belt through hole 8 and a belt attaching rod 9 are integrally disposed, at the inside of the housing 3, the partition pieces 13 are protruded on the upper plate 4 and the lower plate 5 in the central longitudinal direction, and on the inner surfaces on both sides of the upper plate 4 and the lower plate 5 on the side of the belt through hole 8, an engaging protrusions 14 are formed.

Figure 25:
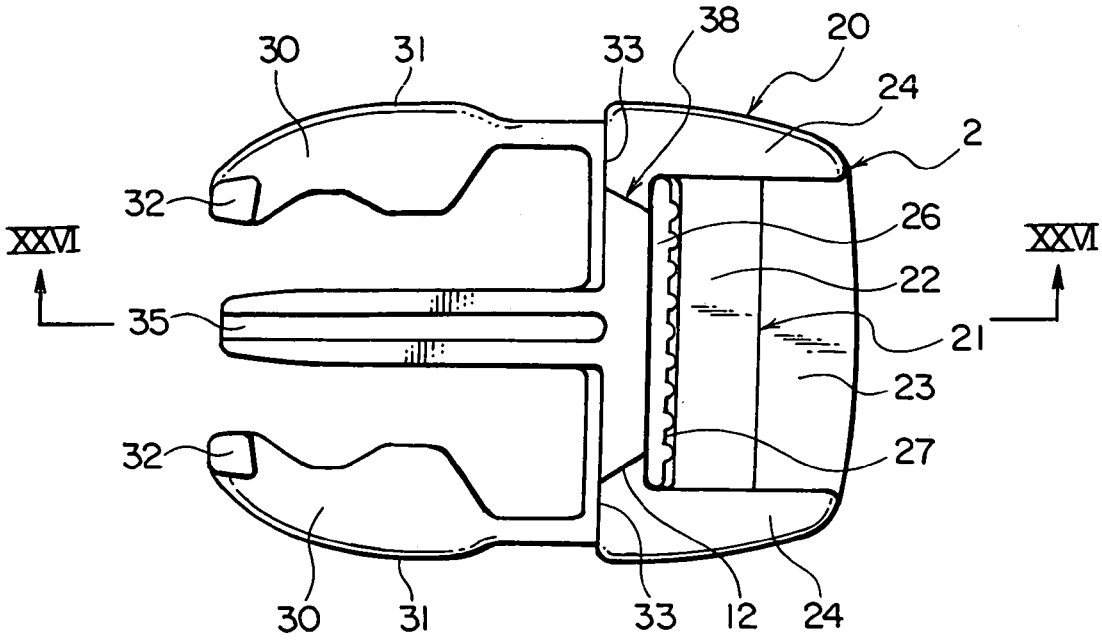
FIG. 25 is a front view of a male body of the buckle of FIG. 20.
Figure 26:
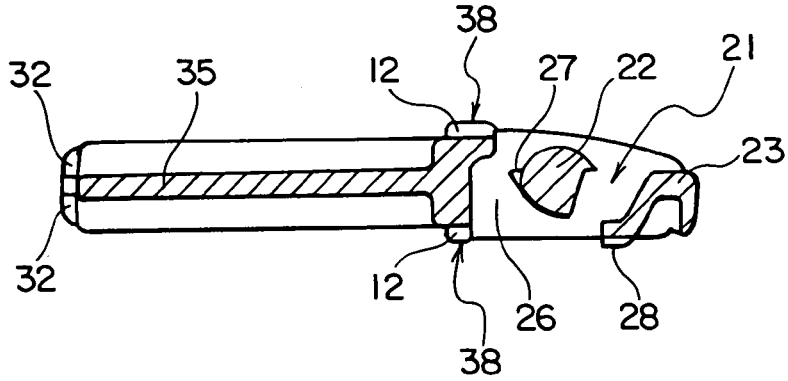
FIG. 26 is a cross-sectional view of the buckle of FIG. 20 taken along the line XXVI—XXVI of FIG. 25.

For the male body 2, as shown in FIGS. 25 and 26, the front surface of the base 25 of the fame 20 is straight and flexible insertion legs 30 disposed so as to protrude on both right and left sides, and at the middle of the flexible insertion leg 30, an pressing portion 31 is formed, at the front end thereof, the engaging portion 32 is formed on the front and the rear, and at the center of the base 25, a guide member 35 with the H-letter shaped cross section is disposed so as to protrude. The belt hooking rod 22 and the fastening rod 23 are bridged in parallel at the side frame 24 of the frame 20, and between the hooking rod 22 and the base 25, a belt through hole 26 is disposed.

For the butting portion 38 formed at the base 25 of the frame 20, the straight portion 33 is formed on each of both sides on both front and rear surface of the base 25, the concave portion 12 capable of being fitted in and matching the convex portion 34 of the female body 1 with the inlet expanded is concavely disposed at the center in the range reaching the belt through hole 26, and when the insertion legs 30 and the guide member 35 are inserted into the insertion opening 7 of the housing 3 of the female body 1, the convex portion 34 of the butting portion 15 disposed in the female body 1 is fitted and fix to the concave portion 12 of the butting portion 38 disposed at the base 25 of the frame 20, and rocking of the buckle in the right and left directions can be prevented by the butting portions 15, 38 of the convex portion 34 and the concave portion 12.

Figure 27:
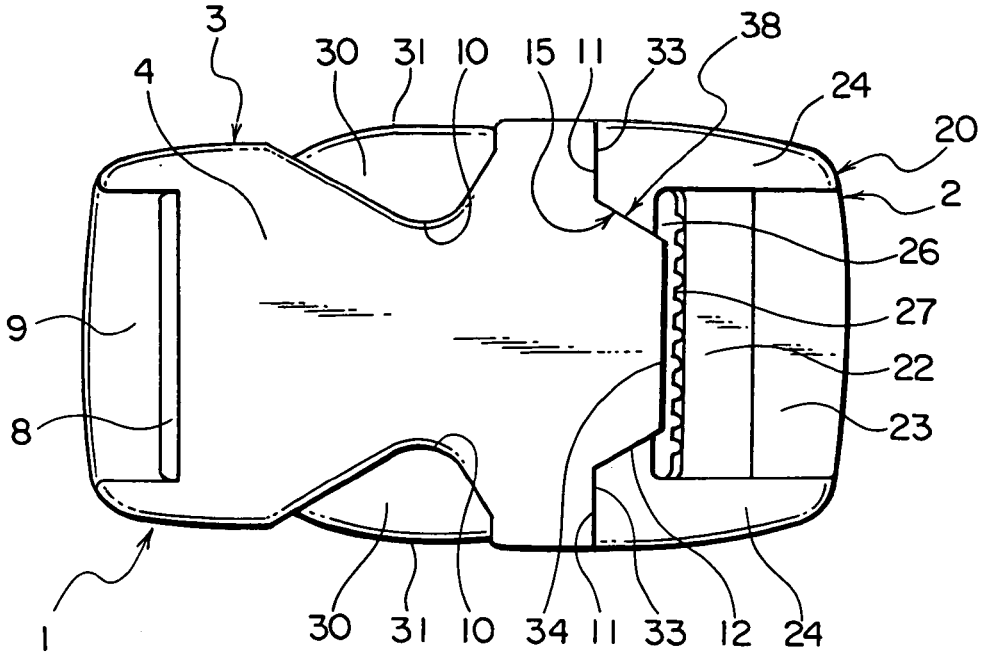
FIG. 27 is a front view showing an engagement state of a buckle according to a modification.
Figure 28:
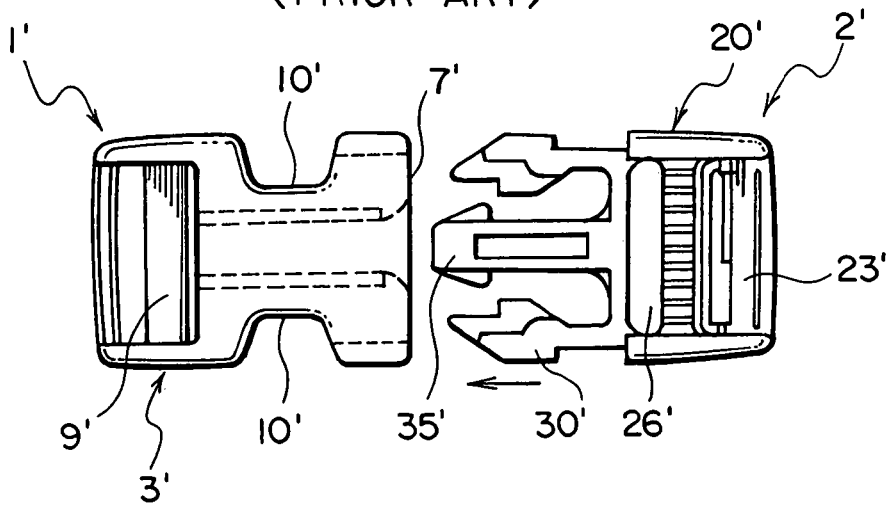
FIG. 28 is a front view of a known buckle.
Figure 29:
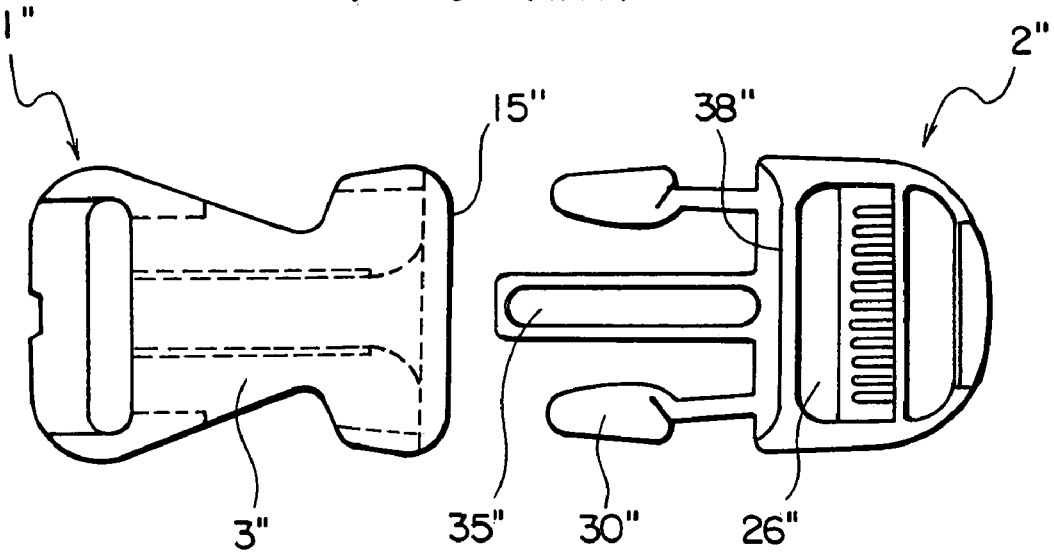
FIG. 29 is a front view of another known buckle.

The buckle shown in FIG. 27 shows a modification of the buckle according to the fourth embodiment. What differs from the aforementioned buckles is to form the butting portion 15 of the convex portion 34 disposed at the insertion opening 7 in the housing 3 of the female body 1 in such a manner as to protrude extendedly up to the top surface of the belt through hole 26 formed in the frame 2 of the male body 2 or to the top surface of the belt hooking rod 22, and to bring the butting portion 15 in contact with the belt inserted through the belt adjusting portion 21 at the front end of the convex portion 34 formed in the female body 1, thereby intending to prevent loosening of the belt.

The buckle according to the present invention has constitutions as described above, and with these constitutions, the following effects are obtained.

According to the invention, there are the effects of preventing rocking in-the right and left directions as well as clattering in the buckle, restricting and holding the female body 1 and the male body 2 in a stable state, and enabling smooth inserting operation with good guide, by providing the buckle comprising the female body 1 formed with a flat housing 3 and the male body 2 having a pair of insertion legs 30, in such a manner that horizontal straight portions 11, 33 are disposed on both sides, and a concave portion 12 or a convex portion 34 at the center in the butting portions 15, 38 on the plane of the female body 1 and the male body 2 when the female body 1 engages with the male body 2, and the female body 1 and the male body 2 are thereby formed closely in contact.

Further, the butting portions 15, 38 comprising the straight portions 11, 33 and the concave portion 12 or convex portion 34 on both the front and rear surfaces of the female body 1 and the male body 2 is provided. Therefore, there is such an effect that a flat buckle that enables the male body 2 to be inserted from either of both front and rear surfaces and that can be used irrespectively of the front and the rear because the butting surface is symmetrical on the front and the rear.

Furthermore, the butting portions 15, 38 comprising the straight portions 11, 33 and the concave portion 12 or the convex portion 34 are formed on one surface of the female body 1 and the male body 2, and on the opposite surface, linear-form butting portions 15, 38 are formed. Therefore, the butting portions 15, 38 are suitable for a buckle with a directionality, or a curved buckle that enable the male body 2 to be inserted only in a specified direction with respect to the front and rear surfaces and restricts the insertion.

Still further, the convex portion 34 in the butting portion 34 is formed in such a manner to be protruded in a trapezoidal form with the front end slightly narrowed and the concave portion 12 is formed in such a manner to be concavely dented with the inlet expanded, or the convex portion 34 in the butting portions 15, 38 is formed in such a manner to protrude arcuately and the concave portion 12 in such a manner to curve in arcuately, thereby forming the butting portions 15, 38 with the straight portions 11, 33 and the convex portion 34 or the concave portion 12. Consequently, a buckle is finished in a stable and excellent design in which the butting portion 15, 38 allows the convex portion 34 to catch and hold the concave portion 12 at the center with the trapezoidal or arcuate convex portion 34 or opposite concave portion 12 and the movement is restricted at of the straight portions 11, 33 on both sides.

Further, the butting portion 15 of the female body 1 is formed with the straight portions 11 and the concave portion 12 and the butting portion 38 of the male body 2 is formed with the straight portions 33 and the convex portion 34 or the butting portion 15 of the female body 1 is formed with the straight portions 11 and the convex portion 34 and the butting portion 38 of the male body 2 is formed with the straight portions 33 and the concave portion 12. Consequently, there is such effects that the buckle of different forms with the concave portion 12 and convex portion 34 at the center of the butting portions 15, 38 reversely arranged is easily made and the buckle suited for the application mode is easily supplied so as to aim at the applicability enlargement.

And further, the peripheral corners of straight portions 33 on both sides and the convex portion 34 at the center of the male body 2 are formed one level lower by notching to form a stepped portion 36, which is allowed to be fitted into the convex portion 12 of the female body 1 in an overlapping state. Therefore, the female body 1 can be joined to the male body 2 in a stable condition and satisfactory manner.

Further, the frame 20 of the male body 2 for attaching the belt can be used effectively by providing the concave portion 12 formed at the center of the male body 2 concavely up to the belt through hole 26 and extending the convex portion 34 of the female body 1 to the belt through hole 26.

Furthermore, there is such effects that loosening of the belt is easily prevented at the belt adjusting portion 21 in the male body 2 and the buckle can be finished with excellent functions by concavely providing the concave portion 12 disposed at the center of the male body 2 up to the belt through hole 26 and extending the convex portion 34 of the upper plate 4 of the female body 1 to the top surface of the belt through hole 26 or the top surface of the hooking rod 22. Therefore, the effects achieved by the invention are remarkably notable.

What is claimed is:

1. A buckle comprising:

a female body formed with a flat housing: and a male body having flexible insertion legs, the female body and the male body being engaged with each other by insertion, each of the female body and the male body having a front surface, a rear surface, right and left side faces, and first butting portions including first straight portions and a concave portion or a convex portion, the concave portion or the convex portion being formed on at least one surface of the front and rear surfaces of the female body or the male body; and second butting portions including second straight portions, which are formed on the right and left side faces and are continuous to the first straight portions of the first butting portions, and including at least one of a third straight portion, which is formed on the other surface of the front and rear surfaces and is continuous to the straight portions formed on the right and left side faces, when the female body engages with the male body, wherein the concave portion or the convex portion is formed at a center of the first butting portions while sandwiched by the first straight portions, the convex portion in the first butting portions protrudes between the flexible insertion legs in a trapezoidal form in which a front end is slightly narrowed, while the concave portion is concavely dented between where the flexible insertion legs are inserted in the trapezoidal form with the inlet expanded, peripheries of the concave portion or the convex portion and the first straight portions on the at least one surface of the front and rear surfaces being continuous with each other peripheries of the second straight portions on the right and left side faces are notched so as to form a one level lower stepped portion, which is capable of being fitted into the second butting portion of the female body or the male body in a manner of overlapping, a guide member is protruded linearly from a center of a front end of the concave portion or the convex portion of the male body, partition pieces for guiding the guide member on a same line as an axis line of the guide member are provided on an inner surface of the housing of the female body, and the front surfaces of the female body and the male body are formed in a same plane, while the rear surfaces of the female body and the male body are formed in a same plane.

2. The buckle according to claim 1, wherein the first butting portions comprising the first straight portions and the concave portion or the convex portion are formed on both front and rear surfaces of the female body and the male body.

3. The buckle according to claim 1, wherein the first butting portions comprising the first straight portions and the concave portions or the convex portion are formed on one surface of the female body and the male body, and on the opposite surface, linear-form butting portions are formed.

4. The buckle according to claim 1, wherein the first butting portion of the female body is formed by the first straight portions and the concave portion and the first butting portion of the male body is formed by the first straight portions and the convex portion.

5. The buckle according to claim 1, wherein the first butting portion of the female body is formed by the first straight portions and the convex portion and the first butting portion of the male body is formed by the first straight portions and the concave portion.

6. The buckle according to claim 5, wherein the concave portion provided at the center of the male body is formed concavely up to a belt through hole, while the convex portion of the female body is extended to the belt through hole.

7. The buckle according to claim 5, characterized in that the concave portion disposed at the center of the male body is formed concavely up to the belt through hole, while the convex portion of the upper plate of the female body is extended to a top surface of the belt through hole or a top surface of a hooking rod.

* * * * *

UNITED STATES PATENT AND TRADEMARK OFFICE

CERTIFICATE OF CORRECTION

PATENT NO. : 7,055,226 B2 
APPLICATION NO. : 09/963577
DATED : June 6, 2006
INVENTOR(S) : Ryoichiro Uehara, Tomohisa Ishida and Yukio Kamagata It is certified that error appears in the above-identified patent and that said Letters Patent is hereby corrected as shown below:

On the title page, item (57), line 2, “inserted each” should read --inserted into each--.

On the title page, item (57), line 12, “in female” should read --in the female--.

In claim 1, column 10, line 9, “housing:” should read --housing;--.

Signed and Sealed this

Twenty-second Day of August, 2006

JON W. DUDAS
*Director of the United States Patent and Trademark Office*